US006375115B1

(12) United States Patent
Reed

(10) Patent No.: US 6,375,115 B1
(45) Date of Patent: Apr. 23, 2002

(54) ELECTRICIAN WIRE CADDY

(76) Inventor: Mark A. Reed, 4387 Caledonia-Steens Rd., Caledonia, MS (US) 39740

( * ) Notice: Subject to any disclaimer, the term of this patent is extended or adjusted under 35 U.S.C. 154(b) by 0 days.

(21) Appl. No.: 09/478,709

(22) Filed: Jan. 6, 2000

(51) Int. Cl.[7] ..... B65H 16/06
(52) U.S. Cl. ..... 242/594.4; 206/389; 206/485
(58) Field of Search ..... 242/588.3, 422.4, 242/594.2, 595, 570, 588, 588.6, 594.4, 325, 327, 159, 160.2, 160.4, 590; 206/389, 391, 392, 485

(56) References Cited

U.S. PATENT DOCUMENTS

| | | | | | |
|---|---|---|---|---|---|
| 334,796 | A | * | 1/1886 | Moore | |
| 634,589 | A | * | 10/1899 | Russell | |
| 1,600,183 | A | * | 9/1926 | Kruse | |
| 2,740,517 | A | * | 4/1956 | Evans | 206/16 |
| 3,647,155 | A | * | 3/1972 | Jorgenson | 242/106 |
| 3,964,613 | A | * | 6/1976 | Anderson, Jr. | 211/64 |
| 4,186,833 | A | * | 2/1980 | Homan | 206/225 |
| 4,773,690 | A | * | 9/1988 | Heinegg | 294/146 |
| 4,815,593 | A | * | 3/1989 | Brown | 206/315.11 |
| D320,687 | S | * | 10/1991 | Perry | D34/44 |
| 5,058,302 | A | * | 10/1991 | Minneman | 42/94 |
| 5,339,956 | A | * | 8/1994 | Thomason | 260/372 |
| 5,482,226 | A | * | 1/1996 | Choate | 242/588 |
| 5,503,571 | A | * | 4/1996 | Cheslock | 439/501 |
| 5,505,303 | A | * | 4/1996 | Sirman | 206/373 |
| 6,199,791 | B1 | * | 3/2001 | Conran et al. | 242/560.2 |
| 6,224,011 | B1 | * | 5/2001 | Gavaza, III | 242/597.4 |

* cited by examiner

*Primary Examiner*—Donald P. Walsh
*Assistant Examiner*—Mark J. Beauchaine
(74) *Attorney, Agent, or Firm*—Garvey, Smith, Nehrbass & Doody, L.L.C.

(57) ABSTRACT

An electrician's combination tool box and wire caddy provides a support for multiple spools of wire of different size or gauge, and a storage area below the spools for holding articles and tools needed by the electrician during the wiring of a building. The spools are positioned well above the storage area, enabling a user to access articles in the receptacles, even when spools are being handled to pay out wire.

9 Claims, 4 Drawing Sheets

ELECTRICIAN WIRE CADDY

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to cases, caddies and tool boxes. More particularly, the present invention relates to an improved electrician's wire caddy and tool box apparatus that affords an electrician who is running wire in an installation the ability to pay out wire of one or more different gauges from a plurality of spools that are mounted at the upper portion of a tool box or case, and having a lower storage area with a plurality of compartments for containing articles to be used by the electrician such as tools, receptacles, switches, wire nuts, switch covers and the like.

2. General Background of the Invention

Electrical installation in buildings occurs in basically two segments. First, the conduit and switch and receptacle boxes are roughed in, locating the routes where the electrical wiring is actually run. At the time the conduit is put in, various boxes for receptacles, switches and the like are located, attached to the conduit and made ready for the mounting of the receptacles and switches.

After the conduit is run, and usually before the wallboard is placed on the studs, an electrician returns to pull wire through the conduit and install the various receptacles, switches and other like fittings.

The standard wire pulled in circuits of this type is typically No. 12 or gauge 12, typically available on 500 ft. spools. It is not uncommon to pull multiple circuits (i.e. more than one wire) at a single pull. During such a pull, the wire spools should be easily accessible to the electrician, enabling the electrician to pull the wires through the conduit to install the various circuits.

Various patents have issued for tool boxes, receptacles, caddies and the like that in some cases support or hold spools. One such patent is U.S. Pat. No. 2,342,954 issued to Mercer and entitled "Spool Holder". In the Mercer patent, a spool holder includes a base, a pair of spaced, upwardly extending parallel walls carried by the base, a pair of transversely arranged spaced parallel walls angularly disposed with respect to and joined to the outer side of each of the first pair of walls. Each pair of the parallel walls is adapted to rotatably receive at least one spindle for supporting a spool of yarn or the like and a carrying handle mounted upon and extending between the first mentioned pair of walls. The handle is equipped with guide means for receiving the yarn from the spools.

A gift wrapping storage container is disclosed in the Homan U.S. Pat. No. 4,186,833. The apparatus provides a hinged cover container having ribbon spool storage and dispensing dowels in the cover and a divided major container portion for storage of folded paper in one section and cards and ribbon in a smaller section. The inside of the cover is provided with loops of elastic ribbon for securing hardware useful for wrapping.

The Cohn U.S. Pat. No. 3,150,769 discloses a wire packaging and handling device for items wound on reels such as wire, and specifically to a packaging and handling device for a reel of wire such that individual lengths of wire may be easily unwound without removing the reel from the device. Steaming crates are known for supporting spools of material such as the Carpenter U.S. Pat. No. 1,752,884, and the Daugert et al. U.S. Pat. No. 1,677,385.

Patents have also issued for sewing cabinets that have rods for supporting spools of material. Examples of such sewing cabinets include, for example, U.S. Pat. Nos. 1,858,105 and 2,541,845.

BRIEF SUMMARY OF THE INVENTION

The present invention provides a tool box for an electrician, cable installer or lineman providing both mounting means for the wire-containing spools for paying out wire and storage space for the usual tools, parts and accessories used by the individual installer in the course of installing, routing, or hanging wire or cable.

The present invention provides an apparatus that includes side portions, which either by themselves or with additional supports provide a mounting on a shaft or axle for the spools of wire or cable to be installed. Surplus scrap pieces of conduit are normally available on a job site to be utilized as the shaft or axle for supporting the spools. In the course of running the wire or cable, the spool of wire or cable may rotate on the shaft, while being maintained in the central location of the parts and accessories.

The enclosed portion of the apparatus provides a storage area that may be fitted with a variety of compartments or receptacles for storage of selected parts and accessories. In differing embodiments of the invention, the dividers for forming the individual compartments may be fixed or moveable, in order to provide different styles of toolboxes meeting the preferences of different electricians. In a preferred embodiment, the apparatus provides a closeable cover that can be hinged or otherwise fashioned to the body of the box to prevent inadvertent loss or removal of parts or accessories when the apparatus is unattended, or during transport.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 4:
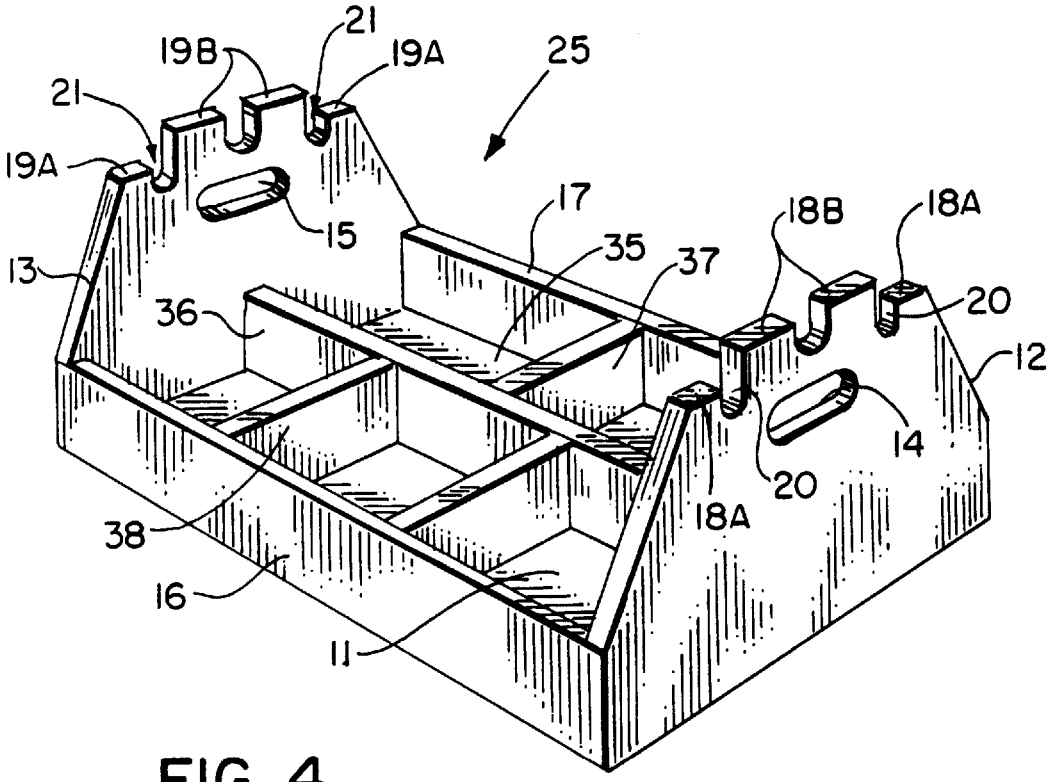
FIG. 4 is a partial perspective view of the preferred embodiment of the apparatus of the present invention.
Figure 5:
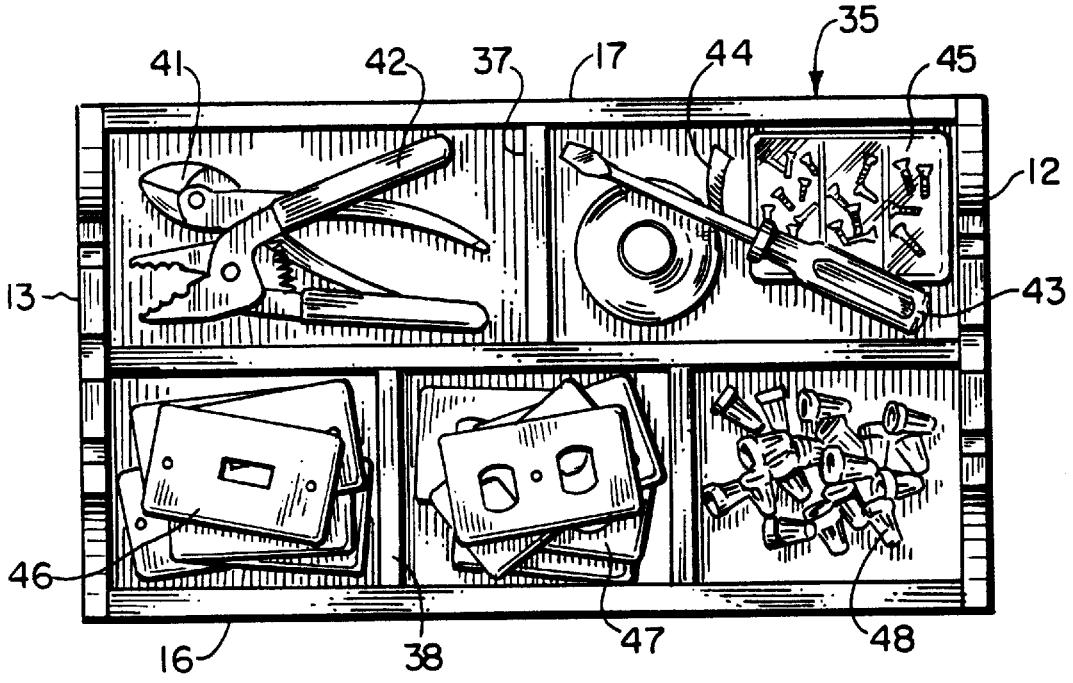
FIG. 5 is a partial plan view of the preferred embodiment of the apparatus of the present invention, showing the storage compartments filled with various articles to be used by an electrician.
Figure 6:
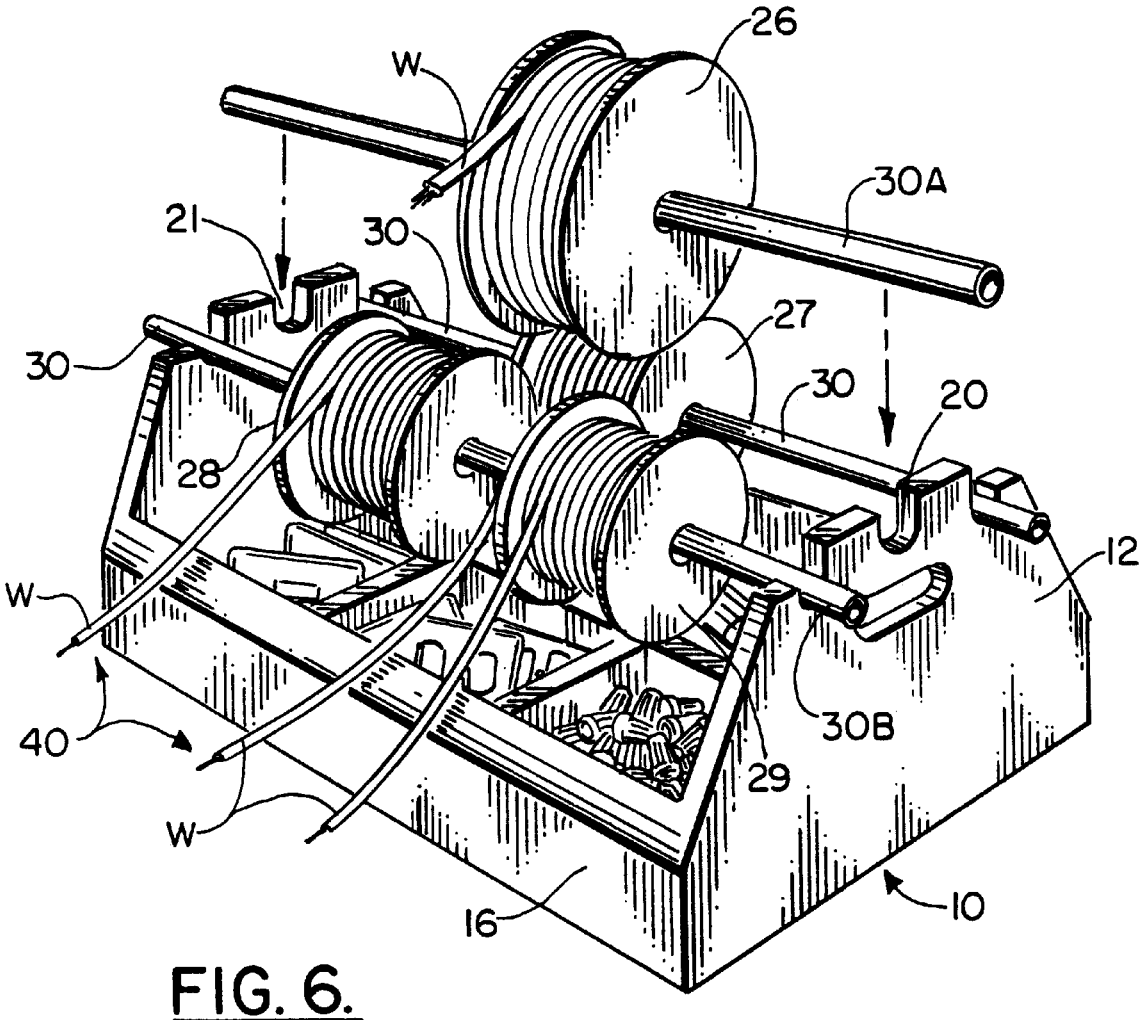
FIG. 6 is a perspective, partially exploded view of the preferred embodiment of the apparatus of the present invention.

FIGS. 1–9 show generally the preferred embodiments of the apparatus of the present invention designated generally by the numeral 10 in FIG. 6. Electrician's wire caddy 10 supports a plurality of spools 26–29, each with a length of wire W that can be payed out for wiring a building or like structure. Caddy 10 also contains tools and articles 41–48 that an electrician uses and can access without requiring repositioning or removal of the spools 26–29.

Case 10 can be constructed of any structural material such as plastic, wood, aluminum or the like.

Figure 7:
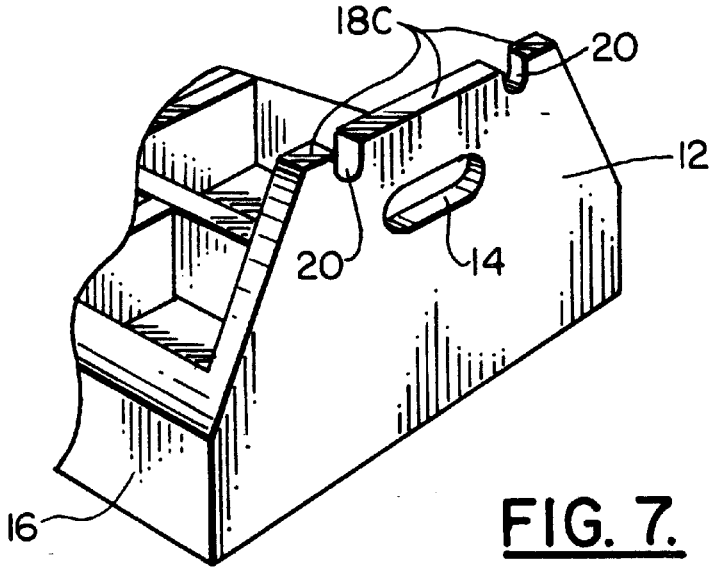
FIG. 7 is a fragmentary, perspective view of the preferred embodiment of the apparatus of the present invention.
Figure 8:
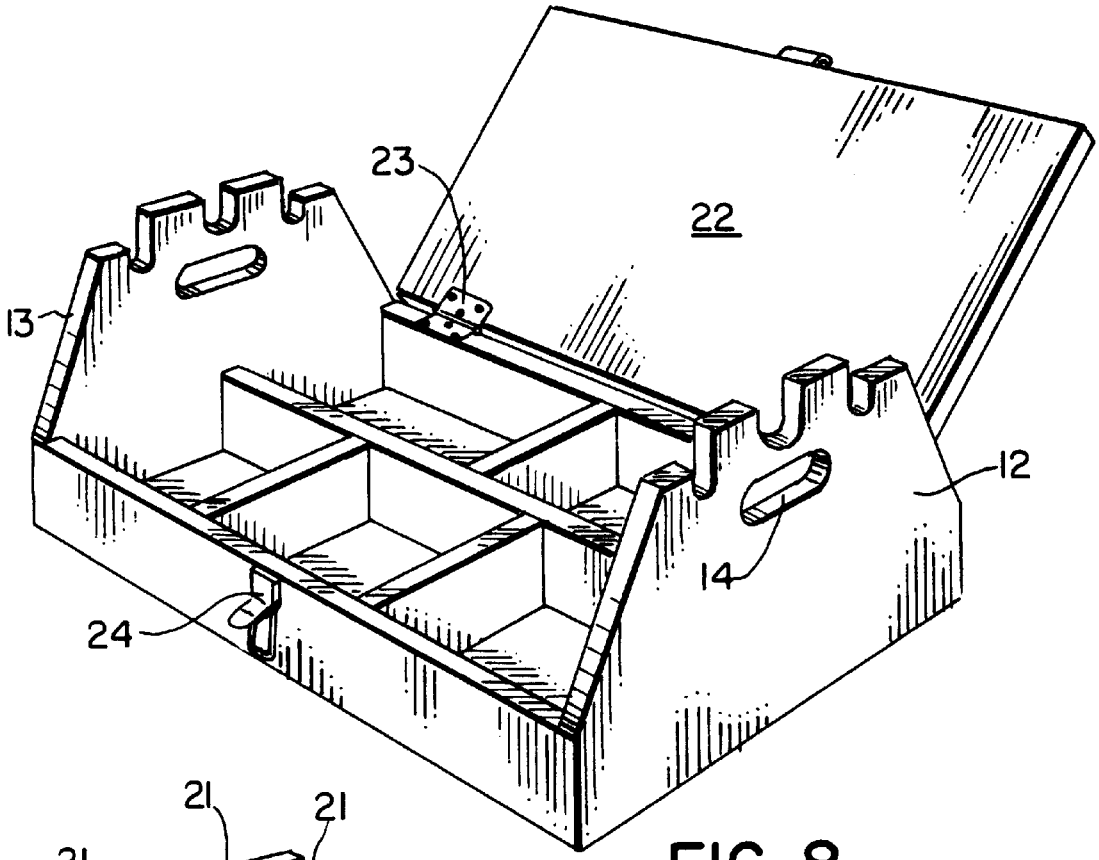
FIG. 8 is a partial perspective view of the preferred embodiment of the apparatus of the present invention showing the spools removed and with the cover opened to expose the storage compartments.
Figure 9:
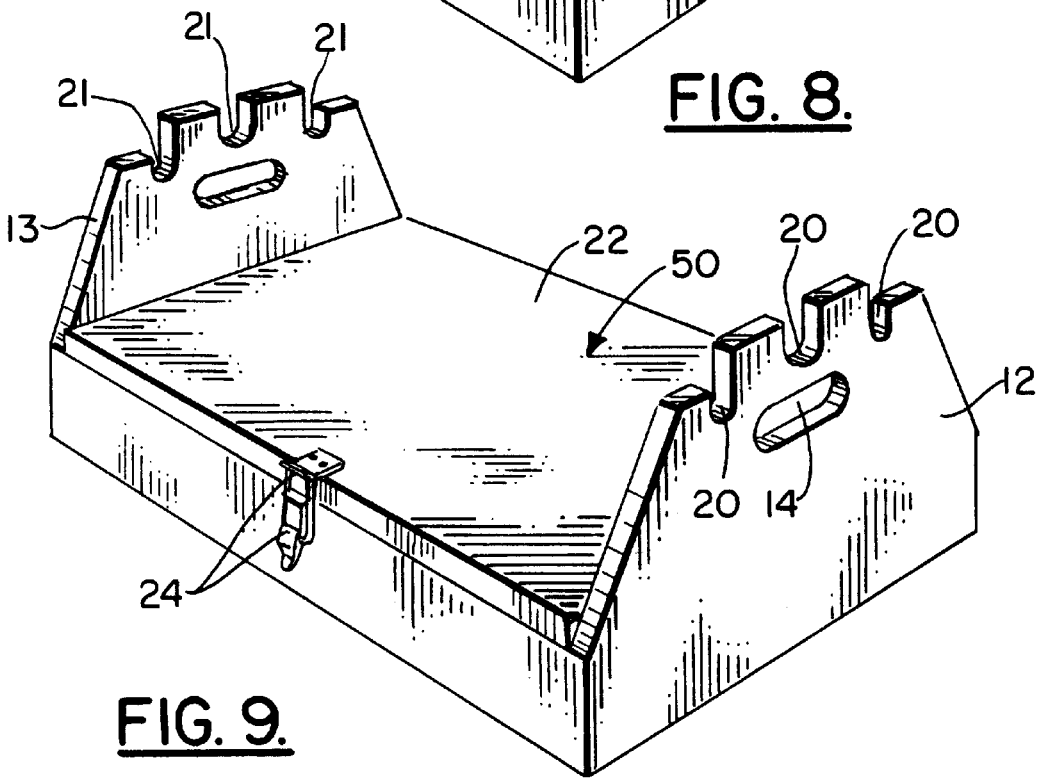
FIG. 9 is a partial, perspective view of the preferred embodiment of the apparatus of the present invention showing the spools removed for clarity and the cover in a closed position.

A supportive base panel 11 or bottom connects with front wall 16, rear wall 17 and side walls 12, 13. Each side wall 12, 13 has a handle 14, 15 respectively. End wall 12 has one or more upper flat surfaces 18. End wall 13 has one or more upper flat surfaces 19. The upper flat surfaces 18 can include surfaces 18A, 18B or 19A, 19B as shown in FIG. 4. In an alternate construction as seen in FIG. 7, all of the upper flat surfaces 18 can be at the same elevational position, such as the plurality of surfaces 18C shown in FIG. 7.

Figure 1:
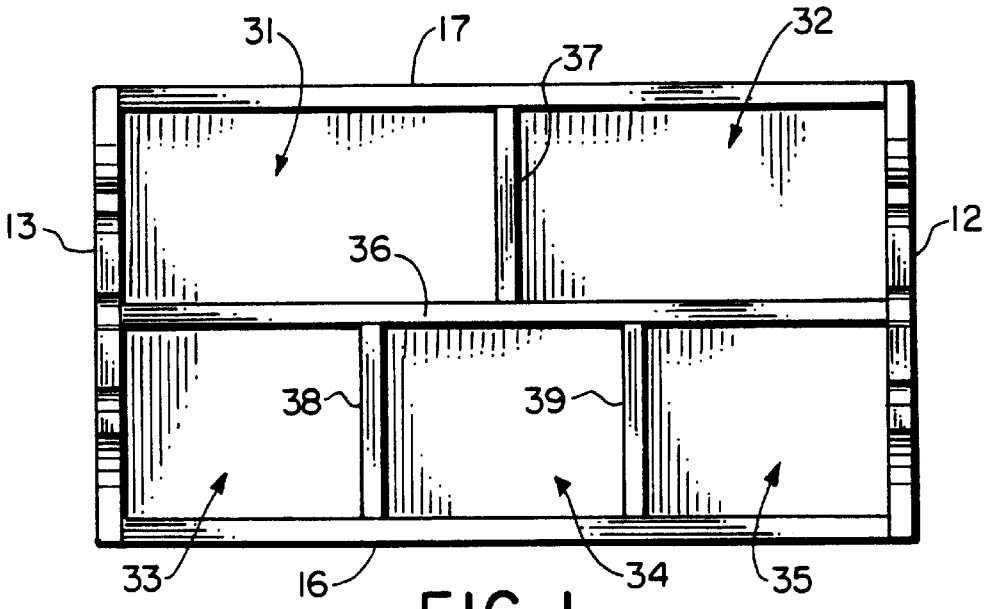
FIG. 1 is a partial top of the preferred embodiment of the apparatus of the present invention.
Figure 2:
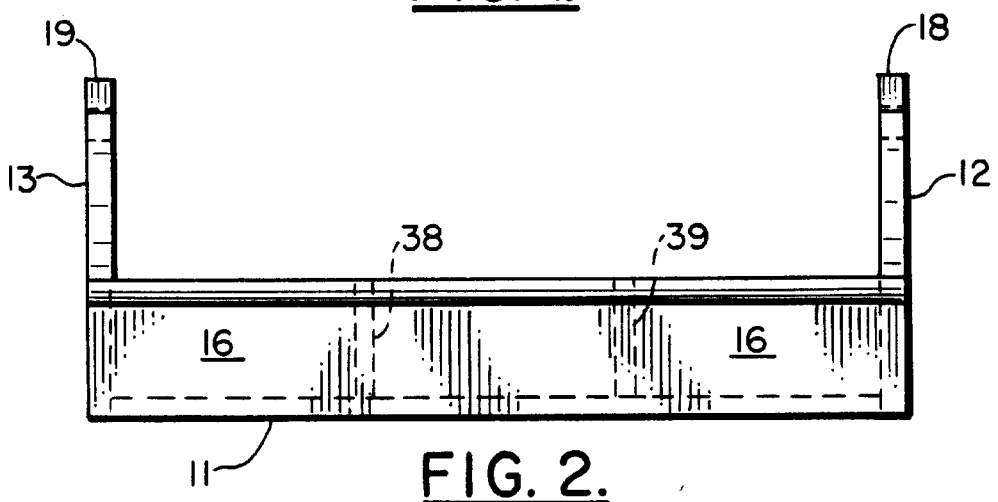
FIG. 2 is a partial elevational view of the preferred embodiment of the apparatus of the present invention.
Figure 3:
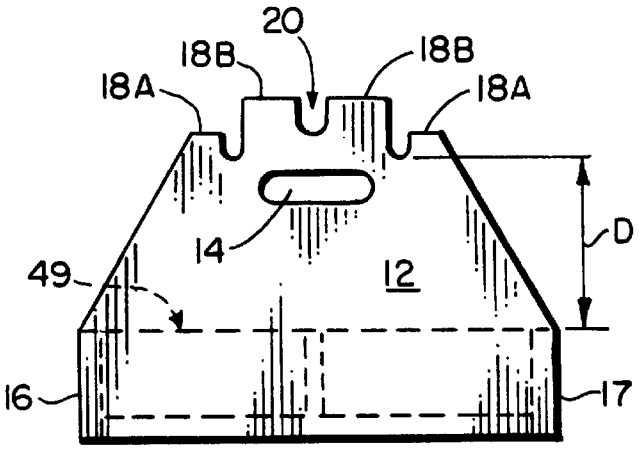
FIG. 3 is a partial side view of the preferred embodiment of the apparatus of the present invention.

Each upper flat surface 18, 19 has a one or more semicircular shaped recesses 20, 21 respectively. Recesses 20, 21 are shaped to receive end portions of spool support rods 30 as shown in FIGS. 3–4. In various preferred embodiments, recesses 20, 21 are of a diameter and depth to receive standard diameter conduit (e.g., ¾ inch, 1 inch diameter) which, when cut to suitable length, serves as the shaft or support rods 30. Each recess 20, 21 is shaped to closely conform to an end of a rod 30 so that rods 30 are securely held when a user pulls electrical wire W from a spool 26,27,28,29 as indicated schematically by arrows 40 in FIG. 6. In preferred embodiments, recesses 20, 21 are of a diameter and depth to receive rods 30 which are lengths of scrap electrical conduit which is available on a job.

Each spool 26, 27, 28, 29 can carry multiple and different gauge wire for example. Each spool 26, 27, 28, 29 is supported in an elevated position above the receptacles 31–35 of storage area 25, enabling a user to access them notwithstanding the above supported spools 26–29.

In FIGS. 2–4 and 6, some of the recesses 20, 21 are placed at higher elevational positions. This construction as shown in FIGS. 3 and 6, enables some of the rods 30 to be placed at higher elevational positions so that spools on an upper most rod 30A (such as spool 26 in FIG. 6) can pay out such as larger gauge wire W (e.g., Romex® cable available from General Wire and Cable, Inc.) above spools such as 28 and 29 that are on a lower rod 30B. In alternative embodiments, upper most rod may be a larger diameter, as 1" conduit so as to support a larger, heavier spool 26 of wire thereby providing the electrician the opportunity to run different types of wire out of the case 10. It is usual that heavy duty insulated cable such as Romex® cable available from General Wire and Cable Company may need to be run during the time that such as 12 and 14 gauge wire. By providing the higher elevational recesses 20,21 on surfaces 18B, 19B, the heavy duty cable may be supported above and clear of receptacles 31–35. In FIG. 7, the recesses 20 are at the same elevational position, in which embodiment may be adapted for installation of lighter gauge wire. This would be true for both of the end walls 12 and 13 though only wall 12 is shown in FIG. 7 for clarification purposes. This latter embodiment of the invention for applications when lighter gauge wires, particularly signal, communication or instrument wiring is being routed in a building under construction.

Storage area 25 is defined by a plurality of baffles including central baffle 36, rear baffle 37, and front baffles 38,39. Baffles 36–39 may be immovably fixed to each other and on base 11, or in alternative embodiments may be moveably fixed in case 10 whereby the sides of the receptacles 31–35 may be adjusted in size to better accommodate various tools or electrical parts being utilized in an installation. In the embodiment illustrated in FIGS. 8 and 9, a cover 22 forms a closure to each receptacle 31–35. Cover 22 attaches to rear wall 17 with such as hinges 23. Clasp 24 secures cover 22 in a closed position by fastening cover 22 to front wall 16. Alternatively, cover 22 may be removably attached to case by such as clasps 24 being disposed in pairs on opposite sides and ends of walls 16, 17.

In FIG. 3, reference line 49 designates a plane that is defined by the top surface 50 of cover 22. A distance D is shown defining the distance between the bottom of a rod 30A or 30B and the plane 49 defined by the upper surface 50 of cover 22. This distance is sufficient to enable a user's hand to access the various compartments 31–35 that contain the various tools and articles 41–48 contained therein. In the preferred embodiment, this distance D is preferably between about 4 and 6 inches. In the preferred embodiment, the spools 26–29 preferably provide a maximum diameter of about 7 inches, except when such as heavy duty cable is mounted on a spool (e.g., 26). In this latter instance, the spool 26 may be 9 to 10 inches in diameter and need to be mounted so as to clear not only recesses 31–35 but also those spools suspended below on surfaces 18A, 19A. For a case 10 to accommodate this usage, surfaces 18B, 19B are required to be about 15 to 18 inches above base 12.

In FIG. 5, exemplary tools and articles are shown being contained within the various compartments 31–35. These include pliers 41, crimping tool 42, screwdriver 43, electrician's tape 44, fasteners box 45, switch cover 46, receptacle cover 47 and a plurality of wire nuts 48 of differing sizes.

PARTS LIST

| Part Number | Description |
|---|---|
| 10 | electrician's wire caddy |
| 11 | base panel |
| 12 | side wall |
| 13 | side wall |
| 14 | handle |
| 15 | handle |
| 16 | front wall |
| 17 | rear wall |
| 18 | upper flat surface |
| 18A | upper flat surface |
| 18B | upper flat surface |
| 18C | upper flat surface |
| 19 | upper flat surface |
| 19A | upper flat surface |
| 19B | upper flat surface |
| 20 | recess |

-continued

| Part Number | Description |
|---|---|
| 21 | recess |
| 22 | cover |
| 23 | hinge |
| 24 | clasp |
| 25 | storage area |
| 26 | spool |
| 27 | spool |
| 28 | spool |
| 29 | spool |
| 30 | rod |
| 30A | upper rod |
| 30B | lower rod |
| 31 | compartment |
| 32 | compartment |
| 33 | compartment |
| 34 | compartment |
| 35 | compartment |
| 36 | central baffle |
| 37 | rear baffle |
| 38 | front baffle |
| 39 | front baffle |
| 40 | arrow |
| 41 | pliers |
| 42 | crimping tool |
| 43 | screwdriver |
| 44 | tape |
| 45 | fasteners box |
| 46 | switch cover |
| 47 | receptacle cover |
| 48 | wire nut |
| 49 | plane |
| D | distance |
| W | wire |

The foregoing embodiments are presented by way of example only; the scope of the present invention is to be limited only by the following claims.

What is claimed is:

1. An electrician's tool box and wire caddy apparatus, comprising:

a) a case that includes a bottom wall, side walls, a front wall and a rear wall, each wall having a height, the side walls being much taller than the front wall and rear wall and terminating in an upper section;

b) said upper sections of said side walls each having disposed therein a u-shaped slot;

c) a spool of electrical wire disposed on a support rod removably attachable to the u-shaped slots in the side walls;

c) said front wall, rear wall and side walls defining a storage space disposed below the spools so that a user can access the storage area without having to remove the spools; and d) a cover that removably attaches to the case for closing the storage area.

2. The electrician's tool box and wire caddy apparatus of claim 1 wherein the storage area includes a plurality of compartments.

3. The electrician's tool box and wire caddy apparatus of claim 1 wherein the support rods have a length which is greater than the distance between the side walls such that the extend beyond the side walls when supported by said u-shaped slots.

4. The electrician's tool box and wire caddy apparatus of claim 1 wherein the spool has a lower end that is at least two inches above the storage area.

5. The electrician's tool box and wire caddy apparatus of claim 1 wherein the cover is positioned entirely below the spools.

6. An electrician's tool box and wire caddy apparatus, comprising:

a) a case that includes a bottom wall, side walls, a front wall, a rear wall, and baffles that define compartments, each wall having a height, the side walls being much taller than the front wall and rear wall and terminating in an upper section;

b) the upper sections of the side walls each having disposed therein a u-shaped slot;

c) a plurality of spools of electrical wire, each spool being supported by a rod, each rod having a pair of rod ends, each rod end resting in a u-shaped slot in a side wall near the top of a side wall;

d) a storage area spaced below the spools and providing an open area above the baffles so that a user can access the storage area without having to remove the spools; and e) a cover that removably attaches to the case for closing the storage area.

7. The electrician's tool box and wire caddy apparatus of claim 6 wherein each spool carries wire of a different gauge.

8. The electrician's tool box and wire caddy apparatus of claim 6 wherein the baffles include baffles that intersect each other at angles.

9. The electrician's tool box and wire caddy apparatus of claim 6 wherein each side wall has a plurality of recesses so that a plurality of spool support rods can be simultaneously supported between opposing side walls.

* * * * *